United States Patent [19]

Okamoto

[11] Patent Number: 4,888,520

[45] Date of Patent: Dec. 19, 1989

[54] MAGNETRON

[75] Inventor: Shingo Okamoto, Kawasaki, Japan

[73] Assignee: Kabushiki Kaisha Toshiba, Kawasaki, Japan

[21] Appl. No.: 127,984

[22] Filed: Dec. 3, 1987

[30] Foreign Application Priority Data

Jan. 28, 1987 [JP] Japan ..... 62-16127

[51] Int. Cl.[4] ..... H01J 19/42

[52] U.S. Cl. ..... 313/292; 313/269; 313/341

[58] Field of Search ..... 315/39.51; 313/340, 313/341, 257, 274, 277, 269, 292

[56] References Cited

U.S. PATENT DOCUMENTS 4,684,845 8/1987 Tsuzurahara et al. ..... 313/341

*Primary Examiner*—Robert L. Griffin
*Assistant Examiner*—T. Salindong
*Attorney, Agent, or Firm*—Foley & Lardner, Schwartz, Jeffery, Schwaab, Mack, Blumenthal & Evans

[57] ABSTRACT

In a magnetron, two rods are supported by a stem in cantilever fashion and a filament (cathode) is connected between two end hats attached to two free ends of the rods. Therefore, these two rods are apt to be vibrated by an external force (e.g. an air screwdriver) during assembly or in transit. To suppress relative displacement of the two rods of magnetron due to external force, the natural frequency of the first vibration system composed of a first rod and a first end hat is determined substantially equal to that of the second vibration system composed of a second rod and a second end hat.

3 Claims, 5 Drawing Sheets

MAGNETRON

BACKGROUND OF THE INVENTION

1. Field of the Invention

The present invention relates to a magnetron incorporated in an electronic range, for instance, and more specifically to a magnetron structure resistant to vibration caused by external force during assembly or in transit.

2. Description of the Prior Art

Usually, a magnetron is composed of a stem, center and side rods supported by the stem, a disk-shaped end hat attached to the center rod, a cylindrical end hat attached to the side rod, and a spiral filament connected between the two end hats. In the conventional magnetron, however, since the two rods are supported by the stem in cantilever fashion, when vibration is applied to the magnetron during assembly or in transit, there exists a problem in that the filament is disconnected or short-circuited or broken at the worst.

The arrangement of the conventional magnetron will be described in further detail hereinafter with reference to attached drawings under DETAILED DESCRIPTION OF THE PREFERRED EMBODIMENTS.

SUMMARY OF THE INVENTION

With these problems in mind, therefore, it is the primary object of the present invention to provide a novel magnetron structure resistant against vibration caused by external force.

To achieve the above-mentioned object, in a magnetron having a stem; a first rod having an end fixed to the stem and a free and; a first end hat fixed to the free end of the first rod; a second rod having a fixed end fixed to the stem and a free and; a second end hat fixed to the free end of the second rod; and a filament connected between the first and second end hats, the present invention is characterized in that a first natural frequency of a first vibration system composed of the first rod and the first end hat is substantially equal to a second natural frequency of a second vibration system composed of the second rod and the second end hat.

In practice, since the two vibration system is not symmetrical in shape and dimensions, a first equivalent mass of the first vibration system is determined to be predetermined times greater than a second equivalent mass of the second vibration system, or vice versa. Similarly, a first spring constant of the first vibration system is determined to be predetermined times greater than a second spring constant of the second vibration system or vice versa.

In the above construction, even if the stem is vibrated by external force and the stem vibration is transmitted to the center rod and the side rod in assembly or transit, since the natural frequency of the first vibration system is roughly equal to that of the second vibration system, it is possible to decrease the relative displacement between the two end hats, thus preventing breakage and short of the filament.

BRIEF DESCRIPTION OF THE DRAWINGS

The features and advantages of a magnetron according to the present invention will be more clearly appreciated from the following description of the preferred embodiment of the invention taken in conjunction with the accompanying drawings in which.

DETAILED DESCRIPTION OF THE PREFERRED EMBODIMENTS

To facilitate an understanding of the present invention, a brief reference will be made to a prior-art magnetron, with reference to the attached drawings.

Figure 1:
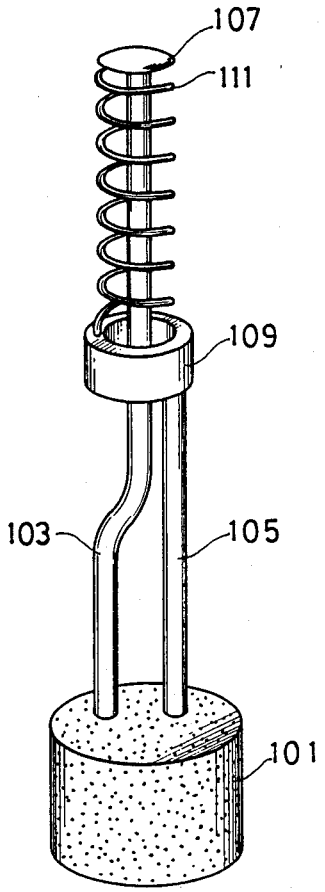
FIG.1 (Prior Art)
FIG. 1 is a perspective view showing the essential portion of the prior-art magnetron.

In FIG. 1, a center rod 103 and a side rod 105 are fixed to a stem 101 provided on the fixed side. In consideration of the influence of heat and electric distribution, but of the rods 103 and 105 are formed into predetermined lengths and supported by the stem in cantilever fashion. Further, a disk-shaped end hat 107 is provided at an end of the center rod 103, and a cylindrical end hat 109 is provided at an end of the side rod 105. The cylindrical end hat 109 is positioned at an intermediate portion of the center rod 103, and a predetermined gap is provided between the cylindrical end hat 109 and the center rod 103. Therefore, the cylindrical end hat 109 is movable relative to the center rod 103 or vice versa.

A spiral thin filament 111 is connected between the cylindrical end hat 109 and the disk-shaped end hat 107, as a cathode. This filament 111 is located at a center of a plurality of vanes arranged within a cylindrical anode (not shown). Under the construction as described above, electrons emitted from the filament 111 during operation are attracted to the anode, so that a high-frequency power will be generated as disclosed in Japanese Unexamined Published (Kokai) Patent Applic. No. 60-32235.

Figure 2A:
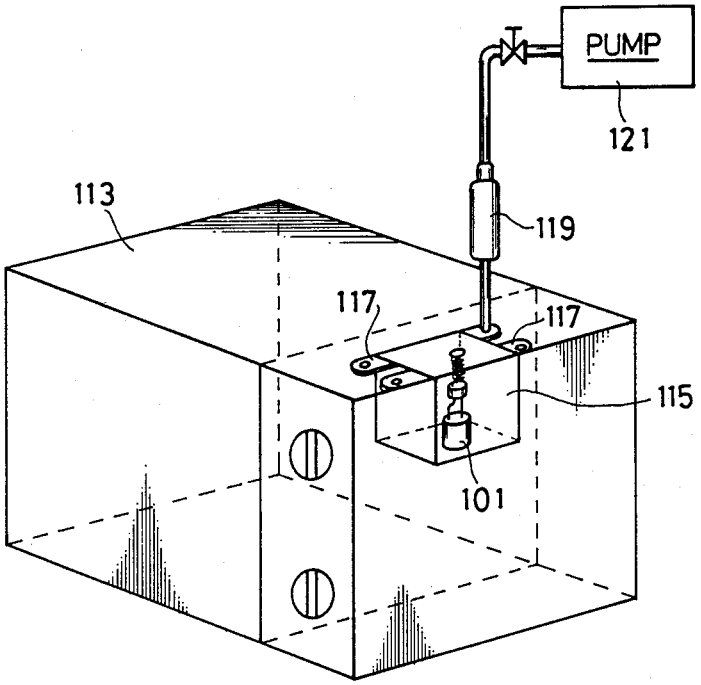
FIG.2(A) ( Prior Art )
FIG. 2(A) is a diagrammatical illustration showing an electronic range in which a magnetron is incorporated by way of example.
Figure 2B:
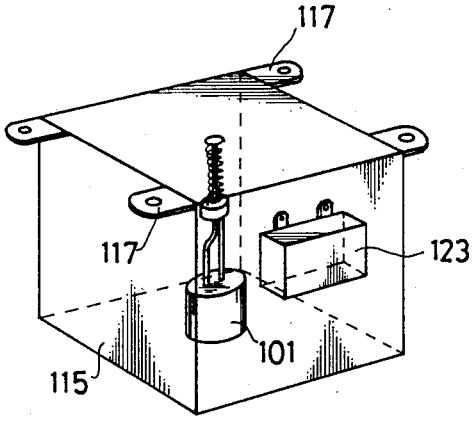
FIG.2(B) (Prior Art)
FIG. 2(B) is a diagrammatic illustration showing a magnetron housing in which a heater is incorporated by way of example.

The magnetron, as described above, is incorporated in an electron range 113, for instance, as shown in FIG. 2(A). In more detail, after the magnetron has been fixed to a magnetron housing 115, flange portions 117 of the magnetron housing 114 are fixed to the electronic range 113 by screws by fastening them by use of an air screwdriver 119 driven by high-pressure air fed from a compressor pump 121. Further, as shown in FIG. 2(B), after the magnetron has been fixed to the magnetron housing 115, a heater thermostat 123 is fixed to the magnetron housing 115 by use of the air screwdriver 119, for instance.

In the conventional magnetron as described above; however, since the center rod 103 and the side rod 105 are both fixed to the stem 101 in cantilever fashion, when the magnetron is mounted on the electronic range 113 or the thermostat 123 is mounted on the magnetron with the screwdriver 119, vibration will be generated. These vibrations are also produced in transit, even after assembly, and transmitted from the stem 101 to the center rod 103 and the side rod 105. Therefore, in case both the rods 103 and 105 are moved toward each other, there exists a hazardous condition such that the thin filament 111 is disconnected by a tensile strength beyond a breaking limit, or the center rod 103 and the side rod 105 are brought into contact with each other so that the filament 111 is shorted, or the filament is broken at the worst.

In view of the above description, reference is now made to an embodiment of a magnetron according to the present invention.

Figure 3A:
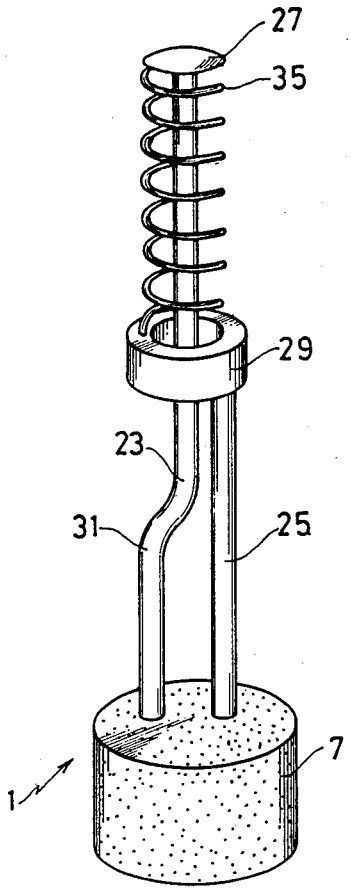
FIG. 3(A) is a perspective view showing the essential portion of a magnetron of the present invention.
Figure 3B:
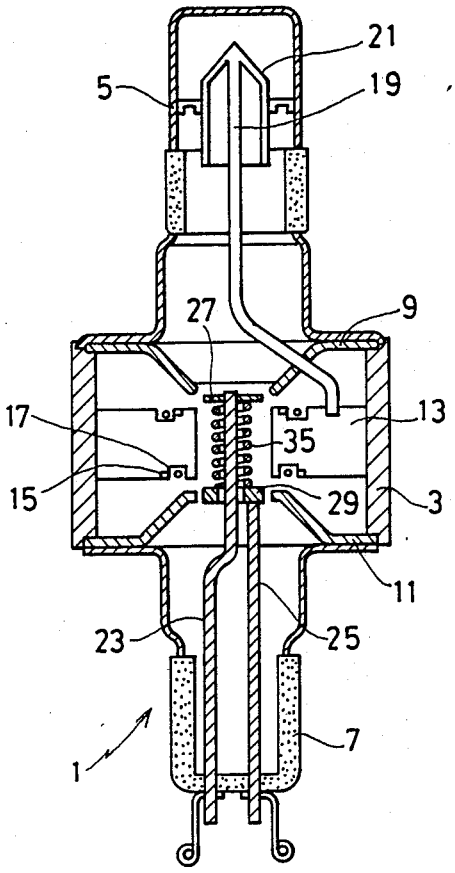
FIG. 3(B) is a cross-sectional view showing an entire magnetron of the present invention.

FIG. 3A shows a magnetron of the present invention, and FIG. 3B shows a diagrammatical structure of the entire magnetron.

In these drawings, a magnetron 1 is roughly divided into three, stem, anode and antenna, sections. The stem section includes a ceramic stem 7, a center rod 23 fixed to the stem 7, a side rod 25 fixed to the stem 7, a disk-shaped end hat 27 attached to a free end of the center rod 23, a cylindrical end hat 29 attached to a free end of the side rod 25, and a spiral thin filament 35 connected between the two end hats 27 and 29.

The center rod 23 is formed with a bent portion 31 at the intermediate portion thereof so as to pass through the center of the cylindrical end hat 29 with a predetermined annular gap between the center rod 23 and the cylindrical end hat 29.

The anode section includes an anode cylinder 3, a pair of funnel-shaped pole pieces 9 and 11 fixed to both opening ends of the cylinder 3, a plurality of vanes 13 disposed radially within the cylinder 3, and two strap rings 15 and 17 having different diameters to link the vanes alternately.

The antenna section includes an antenna conductor 19 connected to one vane 13, and a cylindrical antenna 21 connected to the antenna conductor 19 within an antenna housing 5.

The antenna section is mounted on the upper funnel-shaped pole piece 9, while the stem section is attached to the lower funnel-shaped pole piece 11. Further, the filament 35 is disposed between the center rod 23 and the vanes 13 so that electrons emitted from the filament 35, when activated, are attracted toward the anode cylinder 3 to generate a high-frequency electromagnetic wave.

THe magnetron as described above can be manufactured as follows: One end of the center rod 23 is fixed to the stem 7; one end of the side rod 25 is also fixed to the stem 7 in such a way that the cylindrical end hat 29 is loosely fitted to the center rod 23; the filament 35 is fitted to the center rod 23; the disk-shaped end hat 27 is fixed to the center rod 23; the filament 35 is connected between the cylindrical end hat 29 and the disk-shaped end hat 27.

Figure 4A:
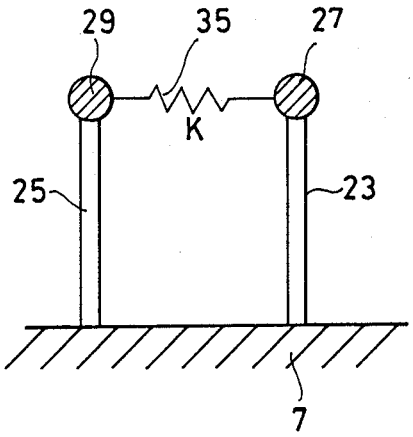
FIG. 4(A) is a diagram showing the essential portion of the magnetron in the form of vibration system model.

The center rod 23 and the side rod 25 are supported in cantilever fashion with an appropriate length under due consideration of the influence of heat and electric distribution upon the two rods. Therefore, it is possible to consider the vibration model of the magnetron as shown in FIG. 4(A), in which the center rod 23 and the disk-shaped end hat 27 constitutes a first vibration system of a cantilever (23) having a concentrated mass (27) at the free end thereof, while the side rod 25 and the cylindrical end hat 29 constitutes a second vibration system of a cantilever (25) having a concentrated mass (29) at the free end thereof with these two vibration systems coupled by a spring (filament) 35.

Figure 4B:
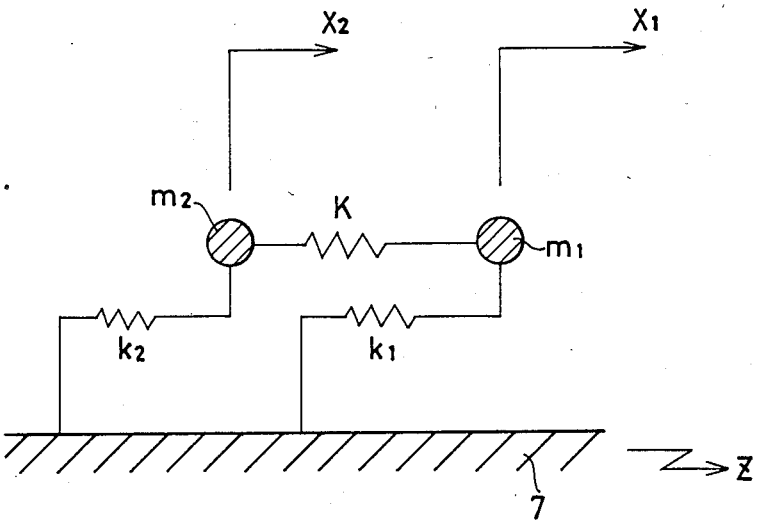
FIG. 4(B) is a diagram showing the same essential portion of the magnetron in the form of two-freedom vibration system diagram.

Therefore, the above magnetron 1 can be modeled into a two-freedom-degree vibration system by use of equivalent masses and equivalent spring constants as shown in FIG. 4(B). In other words, the first vibration system can be expressed by an equivalent mass $m_1$ and an equivalent spring constant $k_1$, while the second vibration system can be expressed by an equivalent mass $m_2$ and an equivalent spring constant $k_2$ with the two systems connected by an equivalent spring K.

Here, the equivalent mass $m_1$ can be given as $$m_1 = mc_1 + 0.236\, mb_1$$

where $mb_1$ denotes a mass of the center rod 23 and $mc_1$ denotes a mass of the disk-shaped end hat 27.

Further, the equivalent spring constant $k_1$ can be given as $$k_1 = \frac{3E_1I_1}{l_1^3}$$

where $E_1$ denotes a Young's modulus of the center rod 23, $I_1$ denotes a geometrical moment of inertia thereof, and $l_1$ denotes a length thereof.

On the other hand, the equivalent mass $m_2$ can be expressed by the following formula $$m_2 = mc_2 + 0.236\, mb_2$$

where $mb_2$ denotes a mass of the side rod 25 and $mc_2$ denotes a mass of the cylindrical end hat 29.

Further, the equivalent spring constant $k_2$ can be given as $$k_2 = \frac{3E_2I_2}{l_2^3}$$

where $E_2$ denotes a Young's modulus of the side rod 25, $I_2$ denotes a geometrical moment of inertia thereof, and $l_2$ denotes a length thereof.

Further, K denotes a spring constant of the filament 35, $x_1$ denotes mutual displacement of the equivalent mass $m_1$ of the first vibration system relative to the stem 7, and $x_2$ denotes mutual displacement of the equivalent mass $m_2$ of the second vibration system relative to the stem 7.

In FIG. 4(B), when forced displacement is applied to the stem 7, the equations of motions of the above vibration systems can be expressed by $$m_1\ddot{X}_1 + (K + k_1)X_1 - KX_2 = m_1\ddot{Z} \quad (1)$$

$$m_2\ddot{X}_2 - KX_1 + (K + K_2)X_2 = m_2\ddot{Z} \quad (2)$$

Here, if $x_1 = X_1e^{j\omega t}$, $x_2 = X_2e^{j\omega t}$, $z = z_0e^{7\omega t}$.

The above equations (1) and (2) are $$\begin{pmatrix} -\omega^2 m_1 + K_1 + k_2 & -K \\ -K & -\omega^2 m_2 + K + k_2 \end{pmatrix} \begin{Bmatrix} X_1 \\ X_2 \end{Bmatrix} = -\omega^2 Z_0 \begin{Bmatrix} m_1 \\ m_2 \end{Bmatrix} \quad (3)$$

Therefore, the above equation (3) can be expressed as $$\begin{Bmatrix} X_1 \\ X_2 \end{Bmatrix} = \frac{-\omega^2 Z_0}{detA} \begin{Bmatrix} m_1(-\omega^2 m_2 + K + k_2) + m_2 K \\ m_2(-\omega^2 m_1 + K + k_1) + m_1 K \end{Bmatrix} \quad (4)$$

where $$detA = (k_1 - \omega^2 m_1)(k_2 - \omega^2 m_2) + \{k_1 + k_2 - \omega^2(m_1 + m_2)\}K \quad (5)$$

As a result, mutual displacement U between $X_1$ and $X_2$ can be expressed as $$U = \frac{-\omega^2 Z_0}{detA}(m_1 k_2 - m_2 k_1) \quad (6)$$

Therefore, if the magnetron 1 is so designed as to satisfy the following equation on the basis of the above equation (6)

$$\frac{k_1}{m_1} = \frac{k_2}{m_2} \quad (7)$$

That is, when the natural frequency $\sqrt{k_1/m_1}$ of the first vibration system is determined to be equal to that $\sqrt{k_2/m_2}$ of the second vibration system, the relative displacement U is theoretically zero, so that the cylindrical end hat 29. Further, in the actual vibration system, although damping will occur, the damping effect is small, and therefore, negligible.

Various experiments indicate that there inevitably exists a dispersion of about ±5% in the natural frequency of the first or second vibration systems from the manufactural standpoint of the magnetron 1. Therefore, where the following expression $$0.9 < \frac{\sqrt{\frac{k2}{m2}}}{\sqrt{\frac{k1}{m1}}} < 1.1 \quad (8)$$

is practically satisfied under consideration of dispersion of both the vibration systems in the magnetron 1, it is possible to roughly equalize the natural frequencies of the two vibration systems to suppress the relative movement between the disk-shaped end hat 27 and the cylindrical end hat 29.

In the magnetron, since the length of the center rod 23 is different from that of the side rod 25 as shown in FIG. 3(A), in practice the equivalent spring constant of the second vibration system (i.e. rod 25) is determined a few times greater than that of the first vibration system (i.e. rod 23). Accordingly, the equivalent mass of the second vibration (i.e. cylindrical end hat 29) is also determined a few times greater than that of the first vibration system (i.e. disk-shaped end hat 27) so as to satisfy the equation (8). Therefore, it is possible to freely determine the length of both the rods 23 and 25, independently while satisfying the equation (8).

To change the equivalent spring constant of the rod, the diameter, length, or material (Young's modulus) of the rod is changed. To change the equivalent mass, the dimension or material (specific gravity) of the rod or the end hat is changed.

Figure 3C:
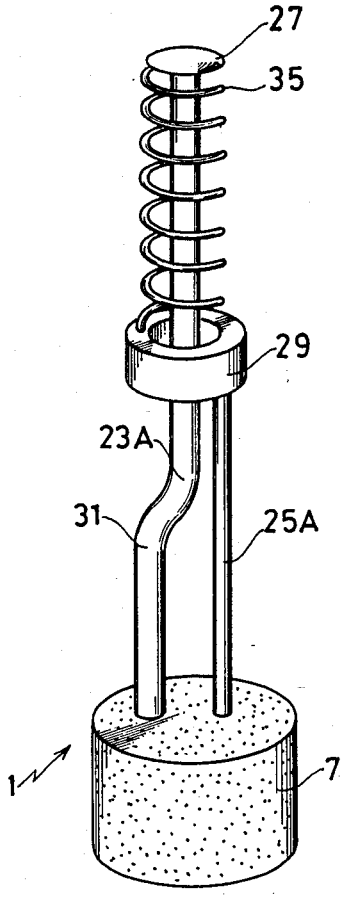
FIG. 3(C) is a perspective view showing a modification of the magnetron of the present invention.

Some experiment has indicated that it is possible to minimize the amplitude of the primary and secondary natural frequencies of the system, when the diameter of the center rod 23A is determined about 1.85 times larger than that of the side rod 25A as shown in FIG. 3(C).

In the above construction, when the magnetron 1 is fixed to a magnetron housing (not shown) or when the magnetron housing is mounted on the electronic range with an air screwdriver or when the electronic range is moved after assembly, even if vibration of the stem 7 is transmitted to the center rod 23 and the side rod 25, the relative displacement between the disk-shaped end hat 27 and the cylindrical end hat 29 can be reduced; tensile strength applied to the filament 35 can be minimized; and therefore disconnection of the filament 35 can be prevented. Further, it is also possible to prevent short circuits caused when the center rod 23 contacts the cylindrical end hat 29.

Further, without being limited to the magnetron, the present invention can be applied to any apparatus such as an electric lamp, which can be modeled into a two-freedom-degree vibration system where two support members for supporting a filament are vibrated in cantilever fashion.

As described above, in the present invention, since ether natural vibration frequency of the first vibration system made up of the center rod and the disk-shaped end hat is roughly equal to that of the second vibration system made up of the side rod and the cylindrical end hat, even if vibration is transmitted to the stem from the outside in assembly or transit, it is possible to suppress the relative displacement of both the vibration systems and tensile force, thus preventing breakage of the cathode and short between the center rod and the cylindrical end hat.

What is claimed is:

1. A magnetron comprising:

a stem;

a first rod having an end fixed to the stem and a free end;

a disk-shaped end hat fixed to the free end of the first rod;

a second rod having an end fixed to the stem and a free end, the first rod being larger in diameter and longer than the second rod;

a cylindrical end hat fixed to the free end of the second rod, said first rod passing through said cylindrical end hat,; and a filament connected between the disk-shaped and cylindrical end hats, wherein the independent natural frequency of a first vibration system composed of the first rod and the disk-shaped end hat is substantially equal to the independent natural frequency of a second vibration system composed of the second rod and the cylindrical end hat.

2. The magnetron as set forth in claim 1, wherein the relationship between the first natural frequency $\sqrt{k_1/m_1}$ of the first vibration system and the second natural frequency $\sqrt{k_2/m_2}$ of the second vibration system is $$0.9 < \frac{\sqrt{\frac{k2}{m2}}}{\sqrt{\frac{k1}{m1}}} < 1.1$$

where $m_1$ denotes an equivalent mass of the first vibration system; $k_1$ denotes an equivalent spring constant of the first vibration system;

$m_2$ denotes an equivalent mass of the second vibration system; and $k_2$ denotes an equivalent spring constant of the second vibration system.

3. The magnetron as set forth in claim 1, wherein one of said first and second rods and said end hat fixed thereto is different in material from the other rod and its end hat.

* * * * *